United States Patent [19]

Hefele

[11] 4,326,004

[45] Apr. 20, 1982

[54] RASTER-SHAPED HEAT-SEALABLE ADHESIVE COATING FOR TEXTILES AND METHOD OF PRODUCING THE SAME USING A POWDER PRINTING PROCEDURE

[75] Inventor: Josef Hefele, Gräfelfing, Fed. Rep. of Germany

[73] Assignee: Kufner Testilwerke KG, Fed. Rep. of Germany

[21] Appl. No.: 125,372

[22] Filed: Feb. 28, 1980

[30] Foreign Application Priority Data

Nov. 19, 1979 [DE] Fed. Rep. of Germany ..... 2946612

[51] Int. Cl.[3] ..... B32B 3/16; B32B 5/16; B32B 5/30; B32B 7/14

[52] U.S. Cl. ..... 428/198; 101/170; 427/197; 427/201; 427/203; 427/208.2; 427/261; 427/265; 428/200; 428/201; 428/212; 428/261; 428/346; 428/354

[58] Field of Search ..... 428/200, 201, 212, 346, 428/354, 198, 261; 101/170; 427/197, 201, 207 A, 203, 261, 265, 208.2

[56] References Cited

U.S. PATENT DOCUMENTS

| | | | |
|---|---|---|---|
| 3,301,741 | 1/1967 | Henrickson et al. | 428/201 |
| 4,139,613 | 2/1979 | Hefele . | |
| 4,141,313 | 2/1979 | Hefele . | |
| 4,183,978 | 1/1980 | Hefele | 428/354 |

*Primary Examiner*—James C. Cannon

*Attorney, Agent, or Firm*—Hill, Van Santen, Steadman, Chiara & Simpson

[57] ABSTRACT

A raster-shaped heat-sealable adhesive coating for textiles is comprised of two adhesive layers, with a first adhesive layer superimposed over a second adhesive layer via a powder printing technique. Preferably, the adhesive layer in direct surface contact with the textile substrate contains a softened polyvinyl chloride material and the second adhesive material is composed of an adhesive material selected from the group consisting of copolyamides, copolyesters and mixtures thereof.

12 Claims, 1 Drawing Figure

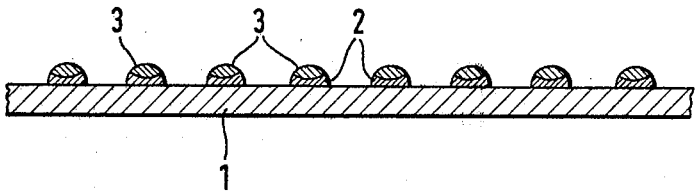
3
3
2
1

RASTER-SHAPED HEAT-SEALABLE ADHESIVE COATING FOR TEXTILES AND METHOD OF PRODUCING THE SAME USING A POWDER PRINTING PROCEDURE

BACKGROUND OF THE INVENTION

1. Field of the Invention

The invention relates to adhesive coatings appliable in select patterns on textiles and somewhat more particularly to a raster-shaped heat-sealable adhesive coating comprised of two layers, one upon the other, applied in a select pattern via powder printing techniques on elongated web-like articles, for example linings for outer garments and to a method of producing such coatings.

2. Prior Art

Bonding of materials with heat-sealable or heat-sealing adhesives applied thereon in select patterns is known. This process is of particular importance in bonding textile materials and in particularly in bonding or gluing linings with outer layer materials. The production of a heat-sealable adhesive coating in a select raster pattern on textile materials can occur via various methods. Such coating production methods include powder printing methods, paste printing methods, screen printing-like methods and even spreading or scattering methods. Depending upon the method utilized, different types of heat-sealable adhesives are utilized. With an increased demand for improved adhesion as well as other properties, such as an avoidance of excessive bond hardening or embrittlement, a lack of wrinkling behavior of the adhesive compound after a cleaning process, etc., the art in recent times has utilized very high grade and expensive adhesive materials, generally based on copolyamides as well as on copolyesters and mixtures thereof. During this same time, textile lining materials have become known with raster-shaped coatings comprised of PVC (polyvinyl chloride), which are typically applied via screen printing methods. However, linings which have been coated in this manner are at least somewhat objectionable, for example, they exhibit a weak adhering characteristic, exhibit a "sweet" odor and exhibit a large amount of wrinkling and a paperlike bond hardening after cleaning of a garment containing a PVC adhesive material.

SUMMARY OF THE INVENTION

The invention provides a raster-shaped heat-sealable adhesive coating for textiles as well as a method of producing such coating whereby the adhesive coating is comprised of two layers, at least one of which contains a PVC (polyvinyl chloride) material, along with an optional softening agent therefor.

In certain preferred embodiments of the invention, the adhesive coating is applied in a select textile raster pattern via powder printing methods so that the adhesive coating layer immediately adjacent to the textile lining surface contains PVC, along with a softening agent therefor, generally about 20 to 70 wt. %, based on the amount of PVC in the layer. The adhesive coating upper-layer is preferably composed of a copolyamide, a copolyester and mixtures thereof. In an exemplary embodiment of the invention, the adhesive coating underlayer (in contact with the lining surface) comprises about 90 to 10% of a material selected from the group consisting of a copolyamide, a copolyester and mixtures thereof and 10 to 90% PVC, which contains a select amount of softening agent therefor.

In accordance with the principles of the invention select raster-shaped heat-sealable adhesive coatings are applied via powder printing techniques during which the PVC-containing adhesive material is granular, having an average particle size of up to a maximum of about 250 μm and such powder is applied as a layer in an essentially known manner as an under-layer of a raster double-layer. In certain embodiments the PVC-containing adhesive powder, which includes a substantially homogeneously distributed softening agent worked thereinto via a tempering process, can be applied as a substantially uniform mixture containing additional heat-sealable adhesive materials selected from the group consisting of copolyamides, copolyesters and mixtures thereof.

BRIEF DESCRIPTION OF THE DRAWING

The single FIGURE is an elevated, cross-sectional, partial, enlarged and somewhat schematic view of a textile surface having a select pattern of a heat-sealable adhesive coating applied thereto in accordance with the principles of the invention.

DESCRIPTION OF THE PREFERRED EMBODIMENTS

During the development of the instant invention, it was surprisingly discovered that raster-shaped heat-sealable adhesive coatings suitable for use on elongated flat web-like articles, such as textile linings for outer garments, are attainable by forming such coatings from two adhesive material layers, which are positioned one over the other via powder printing techniques, with at least one of the adhesive materials comprising a plastic material having a PVC (polyvinyl chloride) base. Such coatings do not exhibit the above-indicated disadvantages of typical PVC-containing coatings applied via the screen printing techniques. The invention thus provides improved raster-shaped (i.e., any select pattern, whether line, intersecting line, autotype, dot, wave, grain, herring-bone, textile, etc., raster pattern), heat-sealable adhesive coating on textile articles (preferably linings for outer garments) and which are comprised of two layers which are positioned one over the other via powder printing technology, with at least one of such layers containing a PVC material and, optionally, a select amount of softening agent therefor.

In accordance with the principles of the invention, suitable PVC-containing layers can be produced from commercially available fine-grained PVC powder, which may be a homopolymer or a copolymer. A typically useful copolymer is, for example, composed of vinyl chloride and vinyl ester. As a more specific exemplary embodiment, the PVC-containing adhesive layer of the invention can be composed of about 85% vinyl chloride and about 15% vinyl acetate.

In general, PVC materials (and it is to be understood in the folling discussion and in the claims that this phrase includes both PVC homopolymers and PVC copolymers) utilized in the practice of the invention are available as powders having an average grain size ranging between about 50 and 150 μm. With many utility-application goals, it is advantageous and sometimes necessary to add an amount of softening agent to a PVC powder. The amount of softening agent can vary in accordance with the nature of the PVC powder utilized and the ultimately desired characteristics. Generally, the amount of softening agent is in the range of about 20 to 70 weight percent, based on the amount of PVC powder and somewhat more specifically, the amount of softening agent preferably ranges between about 35 to 55 weight percent, relative to the amount of PVC powder.

Softening agents for PVC or PVC powders are known. In modifying PVC with softening agents, powder-form softening agents are particularly suitable. Exemplary powder-form softening agents useful in the practice of the invention include cyclohexlphthalate, o-toluene sulfonic acid amide, p-toluene sulfonic acid amide, and mixtures thereof. In addition, certain softening agents which are useful only in narrowly restricted amounts are also useful, such as acidic waxes in powder form.

The PVC-containing layer of the raster-shaped double-layer adhesive coating of the invention can also contain amounts of other heat-sealable adhesive materials (different from PVC). It is preferable that such different heat-sealable adhesive are selected from the materials that form the second adhesive layer, (which functions as a primary adhesive layer). However, such different heat-sealable adhesives can also comprise so-called "foreign powders" composed of copolyamides and/or copolyesters which are not identical with that forming the second adhesive layer. It is preferably to employ a layer (which is sometimes hereinafter referred to as a blocking- or pore-sealing layer) containing an amount of softened PVC, which amount typically is more than about 70 weight percent. Generally, the amount of softened PVC in a blocking-layer can vary over a relative wide range, for example between about 10 to 90 weight percent and somewhat more preferably ranging between about 60 to 90 weight percent.

The second adhesive layer of the raster-shaped double-layer adhesive coating of the invention, which can be applied in the same work step as the first adhesive layer via powder printing techniques, is composed of an adhesive material selected from the group consisting of copolyamides copolyesters, and mixtures thereof. Further, in certain instances, a relatively small amount of PVC can be admixed with the second layer adhesive material, although this is not a preferred embodiment.

A presently preferred embodiment of a raster-shaped double-layer adhesive coating comprises an upper-layer (i.e., a second layer) composed of a copolyamide and/or a copolyester and/or mixtures thereof and an under-layer (i.e., a first layer) composed of a mixture of about 90 to 10 weight percent of a copolyamide and/or a copolyester and/or mixtures thereof and about 10 to 90 weight percent of PVC, which contains a select amount of softening agent.

The PVC-containing layer of the double-layer adhesive coating of the invention can be either the under-layer in direct contact with a substrate being bonded, which is preferred, or, depending upon the nature of the bonding or gluing and the function of the substrate to be glued, can comprise an over-layer. As an over-layer it can, for example, be applied on suitable transfer carrier materials, such as conventional transfer paper, from where it can be transferred, together with an under-layer onto other substrates, such as outer garment textile materials in order to render such garments capable of adhesion.

The application of a heat-sealable double-layer adhesive coating onto a substrate, such as a textile surface, can occur via the powder printing method in accordance with known principles. A particularly useful method and device for applying a desired raster-shaped double-layer is disclosed and claimed in U.S. Pat. Nos. 4,139,613 and 4,141,313 (generally corresponding to German Auslegeschrift 25 36 911), all of which are commonly assigned to the instant assignee and all of which are incorporated herein by reference. Generally, with such method, preferred PVC-powders, particularly when they are produced in suitable form, can be deposited or wiped into patterned cavities or depressions on the peripheral surface of a suitably engraved roll and can be removed therefrom without residue as such powder is applied, for example, as an under-layer on a textile substrate, for example, a lining. In instances where the over-layer is composed of typical heat-sealing adhesive, such as copolyamides and/or copolyesters, which is deposited or wiped into the patterned cavities in the same work step (which layer represents the primary adhesive layer upon a textile substrate), the textile substrate, i.e., a lining, provided with such a coating exhibits typical fixing characteristics of a double-layer coating.

The average granular fineness of the PVC-containing powder utilized in the practice of the invention generally is in the rough range extending up to about 250 μm. When such powder is wiped or otherwise deposited into cavities of an engraved application roll it comprises an upper or over-layer within the cavity of the double-layer filling therein, which, when transferred onto a textile web forms the first or under-layer of the double-layer coating of the invention. In contrast, the adhesive powder utilized to form the under-layer in the cavities of an application roll is substantially finer and preferably has an average granular fineness of below about 150 μm. Upon application, this layer forms the upper or over-layer in the double-layer adhesive coating on a textile surface. Depending on the raster pattern selected, the selection of a particular granular fineness can be advantageous so that, for example, raster patterns having a size greater than 15 mesh (for example 11 mesh) produce favorable results with powders having an average granular fineness above about 150 μm while raster patterns having a smaller size (for example, 17 or 23 mesh) produce favorable results with powders having an average granular fineness or size below about 100 μm.

Before the application of a powder onto an application roll or onto a textile substrate, softening agents are provided to PVC-containing powder via a special tempering process. Generally, an amount of PVC-containing powder is admixed with an amount of softening agent powder and the resultant admixture is tempered at a temperature in the range of about 50° to 80° C. for a period of time sufficient for the softening agent to diffuse uniformly or substantially uniformly into the PVC particles. In this manner, an almost molecularly homogeneous distribution of softening agents is attained within the PVC particles, which is particularly advantageous. As a general rule, tempering time periods ranging between about 1 to 5 days is sufficient and the tempering process can occur at quiescent conditions or with gentle stirring. After the tempering process, the resultant powder again easily crumbles into a particulate form via, for example, a hammer mill or other appropriate attrition device. After attrition, the average size of the PVC-containing particles is in the range of about 200 to 250 μm, beginning from an initial average grain or particle size of about 150 μm.

In embodiments where additional amounts of other heat-sealable adhesive, for example copolyamides and/or copolyesters, are added to the PVC-powder, such additional adhesive powder can be admixed with the PVC-powder shortly before application onto a textile web or, in appropriate circumstances, can be admixed during the above-described tempering process used to introduce softening agents into PVC.

During application of the inventive adhesive coating to a textile substrate, in order to raise the uniformity of the composition of the two layers, it is useful to provide a stirring means at least in the hopper containing the PVC-containing powder which stirring means preferably has an effect over the total width of such hopper, along with a means of sensing and regulating the level or amount of powder in such hopper. In this manner, the powder level can be maintained relatively low to avoid compaction and the composition can be maintained relatively uniform. Thus, depending upon the cavity filling by PVC-containing powder, which may contain a softening agent therefor as well as amounts of other heat-sealable adhesive powder, such as copolyamides and/or copolyester and/or mixtures thereof, an almost constant mixture composition can be attained for the blocking-or pore-sealing layer. For example, with a hopper charge of relatively pure PVC powder (containing an amount of softening agent therefor) an almost constant mixture composition of a blocking-layer can be attained with a PVC composition containing, for example, 85 to 90 weight percent softened PVC and 10 to 15 weight percent of another adhesive powder, originating from the adhesive material forming the second adhesive layer.

It is also useful to provide a stirring means and a means for sensing and regulating material amounts in the second hopper containing the second adhesive material. In this manner, an operator can readily control the weight ratio of the two adhesive layers relative to one another as well as the total amount of adhesive coating applied onto a substrate within relatively narrow limits.

As indicated hereinbefore, the PVC-containing blocking-layer (i.e., the first layer or under-layer in direct surface contact with a textile surface) can optionally contain other heat-sealable adhesives. These heat-sealable adhesives can be identical to the heat-sealable adhesives forming the second adhesive layer or they can be different therefrom. In the normal situation, the second adhesive layer, which is the actual bonding layer, preferably does not contain any PVC-powder.

The heat-sealable or heat-sealing coatings of the invention provide lining materials with typical fixing characteristics of customary dual-coatings for adhesion or bonding with textile outer materials. In addition, the heat-sealable coatings of the invention exhibit a broad fixing tolerances without change in bonding characteristics with different fixing conditions, exhibits a freedom from recoil and exhibit a high adhesive strength, particularly in fixing bonds with outer garment materials which are very difficult to fix, for example silicon-treated poplin.

With the foregoing general discussion in mind, a specific exemplary detailed embodiment which will further illustrate to those skilled in the art the manner in which the invention is practiced, is set forth. However, this example is included merely to aid in the understanding of the invention and variations may be made by those skilled in the art without departing from the spirit and scope of the invention.

EXAMPLE 50 parts by weight of a PVC suspension-homopolymer having an average grain size in the range of about 50 to 150 μm and a K-value of 65 was admixed with 44 parts by weight of cyclohexylphthalate, 10 parts by weight of a mixture of o- and p- toluene sulfonic acid amide and 4 parts by weight of acidic wax, all in relatively finely ground powder form. After admixing, this powdered mixture was tempered for 72 hours at 56° C. under quiescent conditions in a closed plastic container. Approximately 8 days after cooling, the so-tempered material was broken-up via a hammer mill into a particulate form and then screened through a 200 μm sieve. Over-sized particles so-separated were fed back to the hammer mill, reduced in size and again screened. The resultant free-flowing powder was utilized to form the under-layer of the heat-sealable double-layer adhesive coating of the invention on an elongated web of textile lining material.

The patterned over-layer of such a coating was formed from copolyamide powder having an average grain size less than 150 μm.

The apparatus described in the earlier referenced U.S. Patents was utilized in applying the powdered adhesives, with an engraved "printing" roll having a select pattern of cavities (15 mesh) therein.

Select amounts of the two powders, the PVC-containing powder and the copolyamide powder, were placed in the appropriate hoppers, which were provided with a rotating stirring rod and a material height level regulator. The roll associated with the engraved application roll defining the application nip, was heated to about 190° C. and the engraved application roll was heated to about 30° C. and the machine web throughput rate was set at approximately 14 m/min. The size of the doctor blade or wiper associated with the hopper filled with the PVC-containing powder was 0.3 mm and the edge thereof was ground to 135°. Under these operating parameters, an adhesive double-layer coating was applied to an elongated web of textile lining material. The applied coating had a weight of about 20 g/m$^2$, of which about 8 g/m$^2$ was composed of softened PVC and about 12 g/m$^2$ was composed of copolyamide.

The PVC-containing layer, which in the cavities of the application roll comprised the upper layer, was applied onto the textile web surface as the under-layer and the copolyamide under-layer (in the roll cavities) was applied onto such layer as a superimposed primary adhesive layer.

Linings cut-out of the so-coated lining sheet or web were bonded in a conventional manner by ironing, with various outer textile materials. During ironing, no recoil was observed. After conventional cleaning of the ironed bond, neither the relatively soft bond nor its adhesive characteristics changed in any noticeable manner.

Even when the so-coated lining was bonded to highly siliconized poplin, good adhesion values of more than 3,000 p/5 cm were attained.

Referring now to the drawing, a schematic textile sheet 1 is shown as having a patterned double-layer adhesive coating thereon. A PVC-containing layer 2 forms the underlayer in direct contact with the texture surface and a second layer 3 composed of a copolyamide, a copolyester or mixtures thereof lies directly on layer 2. Of course, any select pattern can be utilized as desired.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

I claim as my invention:

1. A raster-shaped heat-sealable adhesive coating on substrates, such as textile liners for outer garments, comprised of two adhesive layers, a first layer superimposed on a second layer via a powder printing technique, and at least one of said layers containing a polyvinyl chloride material and, optionally, a softening agent therefor.

2. A raster-shaped adhesive coating as defined in claim 1 wherein said polyvinyl chloride material comprises an admixture of about 85 percent vinyl chloride and about 15 percent vinyl acetate.

3. A raster-shaped adhesive coating as defined in claim 1 wherein said first layer is in direct contact with a substrate surface and contains a polyvinyl chloride material with a select amount of softening agent therefor.

4. A raster-shaped adhesive coating as defined in claim 3 wherein said select amount of softening agent is about 20 to 70 weight percent, based on the amount of polyvinyl chloride material in said first layer.

5. A raster-shaped adhesive coating as defined in claim 4 wherein said select amount of softening agent is about 35 to 55 weight percent, based on the amount of polyvinyl chloride material in said first layer.

6. A raster-shaped adhesive coating as defined in claim 1 wherein said one layer containing polyvinyl chloride material also contains a select amount of a heat-sealable adhesive material different from said polyvinyl chloride material.

7. A raster-shaped adhesive coating as defined in claim 6 wherein said heat-sealable adhesive material is selected from the group consisting of copolyamides, copolyesters and mixtures thereof.

8. A raster-shaped adhesive coating as defined in claim 1 wherein an other of said layers is composed of an adhesive material selected from the group consisting of copolyamides, copolyesters and mixtures thereof.

9. A raster-shaped adhesive coating as defined in claim 1 wherein said first layer is in direct contact with a substrate surface and is composed of about 90 to 10 percent of an adhesive material selected from the group consisting of copolyamides, copolyesters and mixtures thereof and about 10 to 90 percent polyvinyl chloride material containing a softening agent therefor and said second layer is composed of a material selected from the group consisting of copolyamides, copolyesters and mixtures thereof.

10. A raster-shaped adhesive coating as defined in claim 9 wherein said first layer is composed of about 40 to 10 percent of said adhesive material and about 60 to 90 percent polyvinyl chloride material.

11. A method of producing a raster-shaped heat-sealable adhesive coating on a substrate via powder printing techniques comprising:

providing a polyvinyl chloride-containing adhesive powder having an average particle size up to a maximum of about 250 $\mu$m, providing another adhesive powder having an average particle size of less than about 150 $\mu$m, and sequentially printing said powders onto a substrate surface in a select raster pattern so that said polyvinyl chloride-containing powder is in direct contact with said substrate surface and said another adhesive powder is superimposed onto said polyvinyl chloride-containing powder.

12. A method as defined in claim 11 wherein said providing a polyvinyl chloride-containing adhesive powder includes substantially homogeneously distributing a softening agent for polyvinyl chloride into polyvinyl chloride particles via a tempering process and, optionally, admixing said polyvinyl chloride with an adhesive material selected from the group consisting of copolyamides, copolyesters and mixtures thereof.

* * * * *